US008607884B2

(12) United States Patent
Wheeler et al.

(10) Patent No.: US 8,607,884 B2
(45) Date of Patent: Dec. 17, 2013

(54) PROCESSES OF RECOVERING RESERVES WITH STEAM AND CARBON DIOXIDE INJECTION

(75) Inventors: Thomas James Wheeler, Houston, TX (US); Windsong Fang, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 286 days.

(21) Appl. No.: 13/014,463

(22) Filed: Jan. 26, 2011

(65) Prior Publication Data

US 2011/0186292 A1 Aug. 4, 2011

Related U.S. Application Data

(60) Provisional application No. 61/299,751, filed on Jan. 29, 2010.

(51) Int. Cl.
*E21B 43/16* (2006.01)
*E21B 43/24* (2006.01)

(52) U.S. Cl.
USPC ..... 166/402; 166/270; 166/272.3; 166/308.2; 166/305.1

(58) Field of Classification Search
None
See application file for complete search history.

(56) References Cited

U.S. PATENT DOCUMENTS

| | | | | |
|---|---|---|---|---|
| 3,872,924 | A | 3/1975 | Clampitt | |
| 4,217,956 | A | 8/1980 | Goss et al. | |
| 4,565,249 | A * | 1/1986 | Pebdani et al. | 166/303 |
| 4,617,993 | A | 10/1986 | Brown | |
| 4,649,997 | A | 3/1987 | Bousaid | |
| 4,982,786 | A | 1/1991 | Jennings, Jr. | |
| 5,046,561 | A | 9/1991 | Huang et al. | |
| 5,472,637 | A | 12/1995 | Hart | |
| 5,720,350 | A | 2/1998 | McGuire | |
| 5,725,054 | A | 3/1998 | Shayegi et al. | |
| 5,778,977 | A | 7/1998 | Bowzer et al. | |
| 6,662,872 | B2 * | 12/2003 | Gutek et al. | 166/272.4 |
| 7,303,006 | B2 | 12/2007 | Stone | |
| 7,341,102 | B2 * | 3/2008 | Kresnyak et al. | 166/267 |
| 2003/0062159 | A1 * | 4/2003 | Nasr | 166/272.1 |
| 2003/0102130 | A1 | 6/2003 | Vinegar et al. | |
| 2003/0141073 | A1 | 7/2003 | Kelley | |

(Continued)

FOREIGN PATENT DOCUMENTS

| | | |
|---|---|---|
| CA | 1059432 | 7/1979 |
| WO | WO2006113982 | 11/2006 |
| WO | WO2008009114 | 1/2008 |

OTHER PUBLICATIONS

SPE 100044, "Screening Criteria for Carbon Dioxide Huff 'n' Puff Operations", L. Mohammed-Singh, Petrotrin, and A. K. Singhai and S. Sim, Alberta research Council, 2006, 10 pages.
EOR/IOR, "Screening Criteria for Carbon Dioxide Huff 'n' Puff Operations", JPT, Jan. 2007, pp. 55-57.
"CO2 Injection Offers Considerable Potential Benefits", 1 page.

(Continued)

*Primary Examiner* — Zakiya W Bates
*Assistant Examiner* — Silvana Runyan
(74) *Attorney, Agent, or Firm* — ConocoPhillips Company

(57) ABSTRACT

Methods and systems relate to recovering petroleum products from an underground reservoir. Injection of steam along with carbon dioxide into the reservoir facilitates the recovering, which is further influenced by operating pressure for the injection. Absorption of the carbon dioxide by the products and heat transfer from the steam to the products act to reduce viscosity of the products in order to aid flowing of the products.

12 Claims, 3 Drawing Sheets

(56) References Cited

U.S. PATENT DOCUMENTS

| | | | | |
|---|---|---|---|---|
| 2008/0078552 | A1 | 4/2008 | Donnelly et al. | |
| 2008/0169096 | A1 | 7/2008 | Ayasse | |
| 2008/0257543 | A1 | 10/2008 | De Francesco et al. | |
| 2008/0289821 | A1 | 11/2008 | Betzer Tsilevich | |
| 2008/0289822 | A1* | 11/2008 | Betzer Tsilevich | 166/272.3 |
| 2009/0071648 | A1* | 3/2009 | Hagen et al. | 166/272.1 |
| 2009/0178806 | A1 | 7/2009 | Fraim | |

OTHER PUBLICATIONS

Back to Exploration—2008 CSPG CSEG CWLS Convention, "An Investigation of Oil Viscosity and Depletion Rate Effect on Heavy Oil Recovery by Primary Production and CO2 Huff and Puff Process", Ruiping Shi and Apostolos Kantzas, pp. 480-483.

"Advanced Reservoir Characterization and Evaluation of CO2 Gravity Drainage in the Naturally Fractured Sprayberry Trend Area", Jan. 1-Mar. 31, 1998, David S. Schechter, Contract No. DE-FC22-95BC14942, 20 pages.

* cited by examiner

PROCESSES OF RECOVERING RESERVES WITH STEAM AND CARBON DIOXIDE INJECTION

CROSS-REFERENCE TO RELATED APPLICATIONS

This application is a non-provisional application which claims the benefit of and priority to U.S. Provisional Application Ser. No. 61/299,751 filed Jan. 29, 2010, entitled "Processes of Recovering Reserves with Steam and Carbon Dioxide Injection," which is hereby incorporated by reference in its entirety.

STATEMENT REGARDING FEDERALLY SPONSORED RESEARCH OR DEVELOPMENT

None

FIELD OF THE INVENTION

Embodiments of the invention relate to methods and systems for oil recovery from reservoirs assisted by injection of steam and carbon dioxide into the reservoirs.

BACKGROUND OF THE INVENTION

In order to recover oils from certain geologic formations, injection of steam increases mobility of the oil within the formation via a process known as steam assisted gravity drainage (SAGD). The steam operates to heat the oil as the steam condenses at an interface with the oil that then drains to a producer well. Capital investments, operating costs and discounts on products recovered relative to West Texas Intermediate (WTI) limit payouts for applications based on the SAGD.

Steam generation costs represent a critical factor in these SAGD operations. A steam-to-oil ratio (SOR) provides a measure of steam requirements and is defined as amount of water needed to create the steam that is required to produce an equivalent volume of oil. Along with the steam generation costs, effectiveness of any recovery procedures determines economic feasibility.

One approach for producing the steam relies on conventional boilers or once through steam generators in which water being vaporized is isolated from burners. For greater efficiency, direct steam generation using oxy combustion quenched with water may also output the steam with carbon dioxide for injection into a reservoir. Based on reservoir simulations, accumulation of the carbon dioxide in the reservoir tends to lower the SOR but can decrease temperatures at the interface between the steam and the oil making production uneconomical.

Therefore, a need exists for improved methods and systems for recovery of oil from reservoirs.

SUMMARY OF THE INVENTION

In one embodiment, a method includes injecting a fluid at a pressure above 2500 kilopascals into a subterranean formation. The fluid includes steam with between 5 and 15 weight percent carbon dioxide. The method further includes producing hydrocarbons from the formation that are mobilized by the fluid injected.

According to one embodiment, a method includes selecting injection pressure for a fluid up to a fracture pressure of a subterranean formation and such that the injection pressure is as high as possible given a steam-to-oil ratio influenced by carbon dioxide presence in the fluid injected. In addition, the method includes injecting the fluid at the injection pressure into the formation. The fluid injected includes steam with at least 5 weight percent carbon dioxide and enables producing hydrocarbons from the formation that are mobilized by the fluid.

For one embodiment, a method includes generating a fluid by oxy combustion in presence of water and selecting injection pressure for the fluid having steam with between 5 and 15 weight percent carbon dioxide and less than one weight percent of other constituents. Injecting the fluid at the injection pressure into the formation occurs with the injection pressure selected to be above 2500 kilopascals, up to a fracture pressure of a subterranean formation, and as high as possible given a steam-to-oil ratio influenced by carbon dioxide presence in the fluid injected. Producing hydrocarbons from the formation that are mobilized by the fluid injected occurs through a second wellbore spaced from a first wellbore and located deeper in the formation than the first wellbore through which the injecting occurs.

BRIEF DESCRIPTION OF THE DRAWINGS

The invention, together with further advantages thereof, may best be understood by reference to the following description taken in conjunction with the accompanying drawings.

DETAILED DESCRIPTION OF THE INVENTION

Embodiments of the invention relate to recovering petroleum products from an underground reservoir. Injection of steam along with carbon dioxide into the reservoir facilitates the recovering, which is further influenced by operating pressure for the injection. Absorption of the carbon dioxide by the products and heat transfer from the steam to the products act to reduce viscosity of the products in order to aid flowing of the products.

Figure 1:
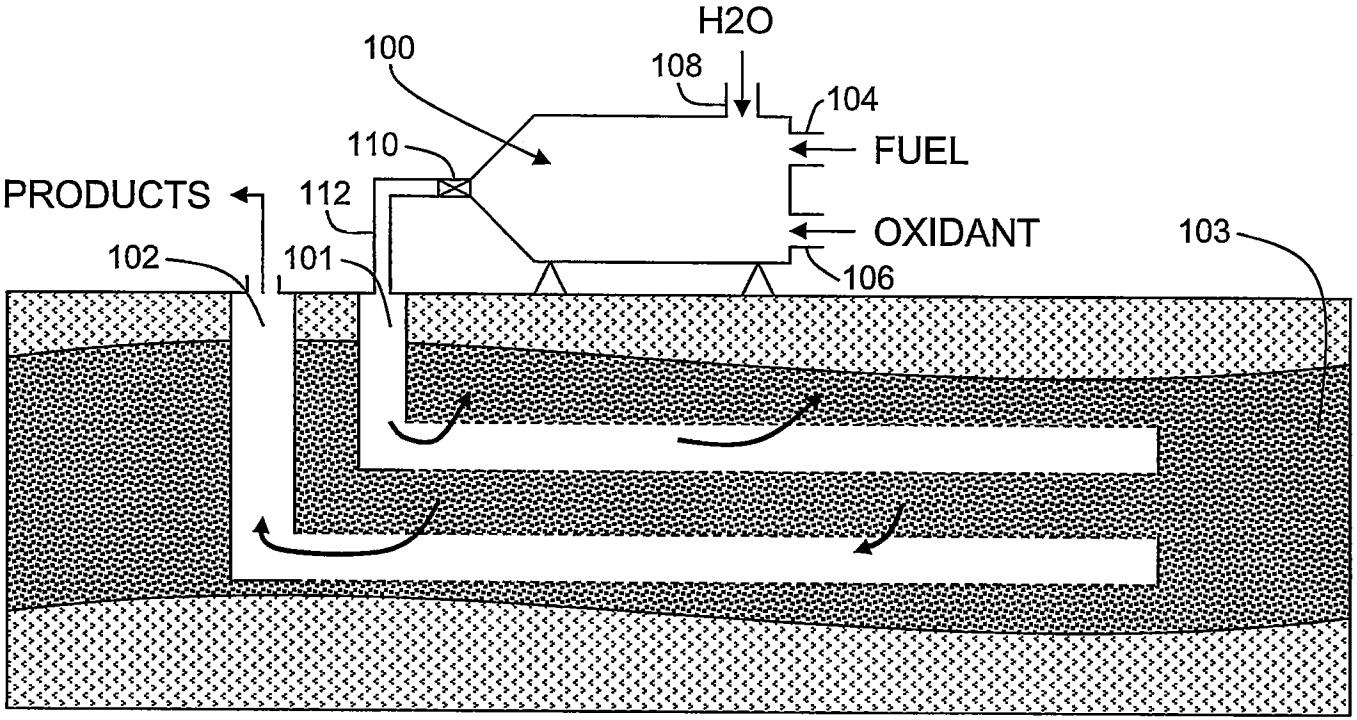
FIG. 1 is a schematic of a production system utilizing direct steam generation to supply a resulting pressurized fluid containing steam and carbon dioxide into an injection well, according to one embodiment of the invention.

FIG. 1 shows a schematic of a direct steam generator (DSG) 100 coupled to supply a fluid to an injection well 101. The fluid includes steam and carbon dioxide produced by the DSG 100. In operation, the fluid makes petroleum products mobile enough to enable or facilitate recovery with, for example, a production well 102. The injection and production wells 101, 102 traverse through an earth formation 103 containing the petroleum products, such as heavy oil or bitumen. For some embodiments, the injection well 101 includes a horizontal borehole portion that is disposed above (e.g., 0 to 6 meters above) and parallel to a horizontal borehole portion of the production well 102. While shown in an exemplary steam assisted gravity drainage (SAGD) well pair orientation, some embodiments utilize other configurations of the injection well 101 and the production well 102, which may be combined with the injection well 101 or arranged crosswise relative to the injection well 101, for example.

The DSG 100 includes a fuel input 104, an oxidant input 106 and a water input 108 that are coupled to respective sources of fuel, oxidant and water and are all in fluid communication with a flow path through the DSG 100. Tubing 112 conveys the fluid from the DSG 100 to the injection well 101 by coupling an output from the flow path through the DSG 100 with the injection well 101. Based on criteria discussed further herein, a flow control device, such as a choke 110, controls pressure of the fluid being injected into the formation 103.

Examples of the oxidant include air, oxygen enriched air and oxygen (i.e., oxy combustion), which may be separated from air. Sources for the fuel include methane, natural gas and hydrogen. In addition to the steam and the carbon dioxide, the fluid input into the injection well 101 may further include solvent for the products that are more viscous than the solvent. For some embodiments, the solvent introduced into the fluid includes hydrocarbons, such as at least one of propane, butane, pentane, hexane, heptane, naphtha, natural gas liquids and natural gas condensate.

The fluid upon exiting the injection well 101 and passing into the formation 103 condenses and contacts the petroleum products to create a mixture of the fluid and the petroleum products. The mixture migrates through the formation 103 due to gravity drainage and is gathered at the production well 102 through which the mixture is recovered to surface. A separation process may divide the mixture into components for recycling of recovered water and/or solvent back to the DSG 100.

The DSG 100 differs from indirect-fired boilers. In particular, transfer of heat produced from combustion occurs by direct contact of the water with combustion gasses. This direct contact avoids thermal inefficiency due to heat transfer resistance across boiler tubes. Further, the combustion gasses form part of the fluid without generating separate flue streams that contain carbon dioxide.

In operation, the fuel and the oxidant combine within the DSG 100 and are ignited such that the combustion gas is generated. The water facilitates cooling of the combustion gas and is vaporized into the steam. Quantity of the water introduced into the flow path of the DSG 100 for some embodiments results in the steam being between about 80% and about 95% by weight of the fluid, the carbon dioxide being between about 5% and about 15% or about 9% and about 12% by weight of the fluid, and remainder (less than 1% by weight of the fluid) being impurities, such as carbon monoxide, hydrogen, and nitrogen with the solvent that if present may be between about 10% and about 20% by weight of the fluid.

In some embodiments, operations utilize injecting the fluid at a pressure above about 2500 kilopascals (kPa), above about 3000 kPa, or between about 2500 kPa and about 4000 kPa, into the formation 103. Selection of the pressure up to a fracture pressure of the formation 103 relies on criteria to establish the injection pressure as high as possible given a steam-to-oil ratio as influenced by carbon dioxide presence in the fluid that is injected. The pressure may be selected to provide at least about 2, or at least about 5, mass percent carbon dioxide solubility in the products at an interface where the steam condenses and heats the products. Upon selecting the pressure, operations may continue injection of the fluid at the pressure for a period of at least about 5 years, or about 10 years. For some embodiments, selection of the pressure provides at least 40 percent, or at least 60 percent, oil recovery from the formation 103 over 10 years.

Figure 2:
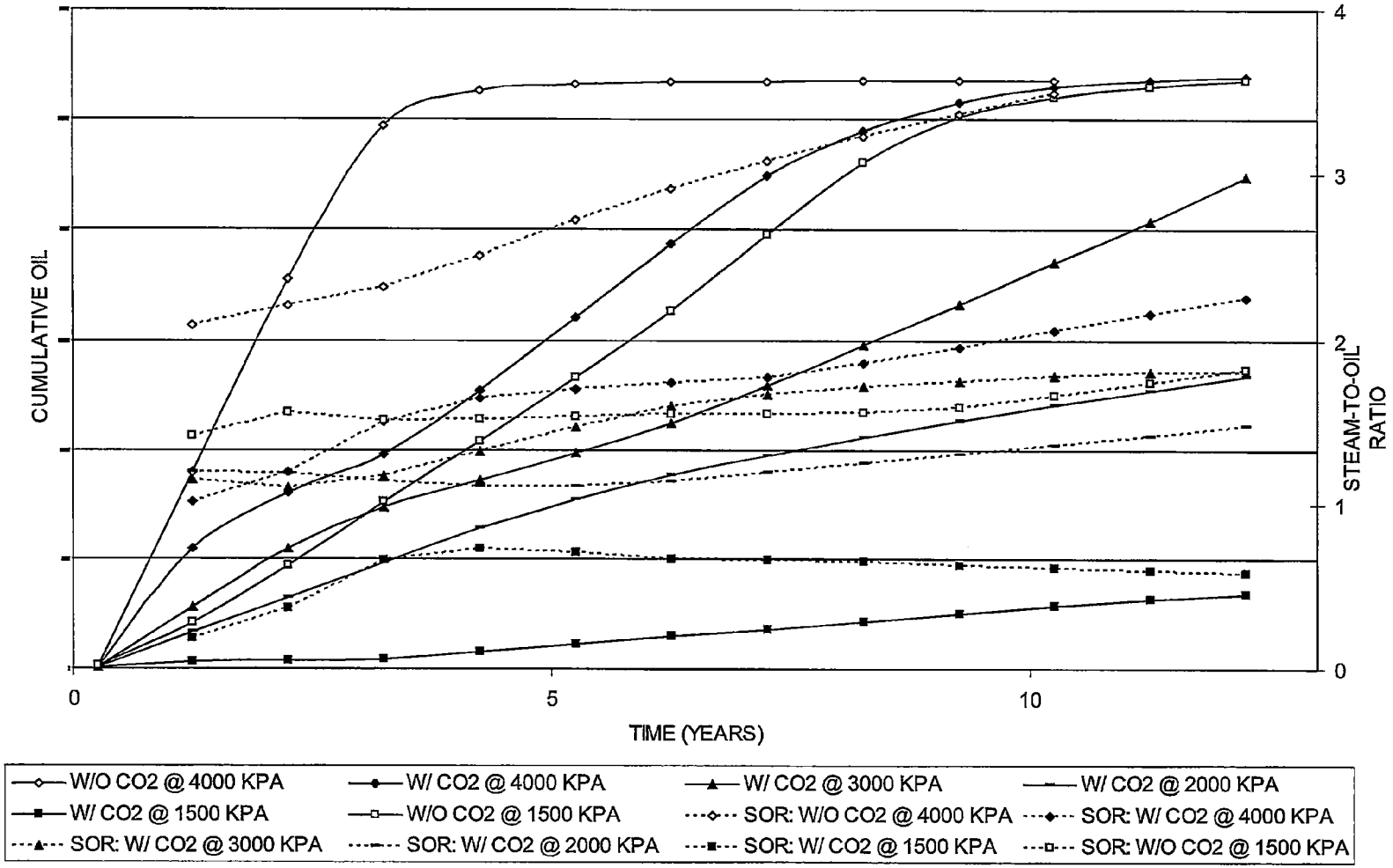
FIG. 2 is a graph showing influences of injection pressure on production when injecting steam with carbon dioxide, according to embodiments of the invention.

FIG. 2 illustrates a graph showing influences of injection pressure on production when injecting the steam with the carbon dioxide. Modeling using STARS™ from CMG (Computer Modeling Group, Ltd.) produced results shown in the graphs herein. The graph shows both a cumulative amount of the products recovered from the formation or oil recovery factor and a cumulative steam-to-oil ratio versus time. Solid curves plot the results for the oil recovery factor with injection of steam containing 12 weight percent of carbon dioxide and at respectively 1500 kPa, 2000 kPa, 3000 kPa and 4000 kPa. Dashed curves correspond likewise for the cumulative steam-to-oil ratios. For comparison, solid comparative lines plotting the oil recovery factor and dashed comparative lines plotting the steam-to-oil ratio correspond to the results for injection of steam without carbon dioxide and at 1500 kPa and 4000 kPa injection pressures.

As seen in the graph, operating at 1500 kPa with the carbon dioxide in the steam lowered the steam-to-oil ratio relative to operating at 1500 kPa without the carbon dioxide in the steam but at expense of unacceptable and uneconomical loss in the oil recovery factor. Further, production rate dropped 88% for the injection at 1500 kPa of steam with the carbon dioxide compared to injection at 1500 kPa of steam without the carbon dioxide. However, the production rate only reduced 46% for the injection at 4000 kPa of steam with the carbon dioxide compared to injection at 4000 kPa of steam without the carbon dioxide. This disparity in production rate drop as a function of pressure illustrates a synergistic relationship between carbon dioxide and pressure influences on production when injecting a combination of steam and carbon dioxide. The oil recovery factor after 10 years thus about matched for both the injections with and without carbon dioxide at 4000 kPa even though the steam-to-oil ratio remained lower as desirable for the injection with carbon dioxide compared to without carbon dioxide.

Economic calculations based on the results can yield net present value of such operations. The steam-to-oil ratio when combined with gas price to generate the steam influences the net present value calculated on however much products are recovered over time. By way of example, the calculations demonstrated an economic loss for injection at 1500 kPa and with carbon dioxide and a higher and even more profitable net present value for injection with carbon dioxide and at both 3000 kPa and 4000 kPa than injection at 3000 kPa or 4000 kPa and without carbon dioxide. Variables (and assumptions) used in the calculations include production rate (determined by the modeling), discount rate (10%), bitumen price ($30 per barrel), the gas price ($8 per MMBTU), non-fuel operating expense ($8 per barrel), escalation (2.5% per year), and well/pad costs ($9 million). Without proper selection of the pressure for injection, the carbon dioxide while acting to lower the steam-to-oil ratio can nevertheless be detrimental to operation economics.

While not limited to any particular theories described herein, pressurization of the fluid limits accumulation of the carbon dioxide in a resulting steam chamber in the formation 103 thereby allowing control of insulating effect provided by the carbon dioxide. In particular, the pressure influences the carbon dioxide solubility in the products since the solubility increases as the pressure is raised. Absorbing of the carbon dioxide by the products reduces viscosity of the products heated by the steam to also increase mobility of the products. Since solubility of the carbon dioxide into the products increase as temperature decreases, the carbon dioxide tends to migrate through the products and reduce the viscosity of the products throughout a larger area than heated by the steam chamber.

The carbon dioxide when operated at the pressurization aides in directing heat transfer from the steam into the bitumen since more heat transfer occurs where there is fluidic movement. This phenomenon further limits heat loss to an overburden formation since the carbon dioxide cannot migrate into the overburden, which therefore blocks fluidic movement. The solubility of the carbon dioxide due to the pressurization mixes gasses in the steam chamber because of resulting convective flux caused by carbon dioxide being absorbed into the products and/or water once the steam condenses. The pressurization therefore ensures that the carbon dioxide concentration in the steam chamber increases toward and at a gas-liquid interface, which occurs where the steam condenses at the overburden or upon heating the products. The carbon dioxide along the overburden insulates the steam chamber from unwanted heat loss to the overburden, which may be in contact with a heat thief such as water.

Any additional contact of the steam with the overburden increases inefficient use of the steam. With insufficient pressurization, the carbon dioxide can accumulate in the steam chamber and does not tend to rise toward the overburden given that the carbon dioxide has a higher density than the steam or other gasses such as nitrogen. Maintaining operations at the pressurization selected even after the steam chamber reaches a top of the reservoir or the overburden therefore facilitates in limiting heat loss.

Figure 3:
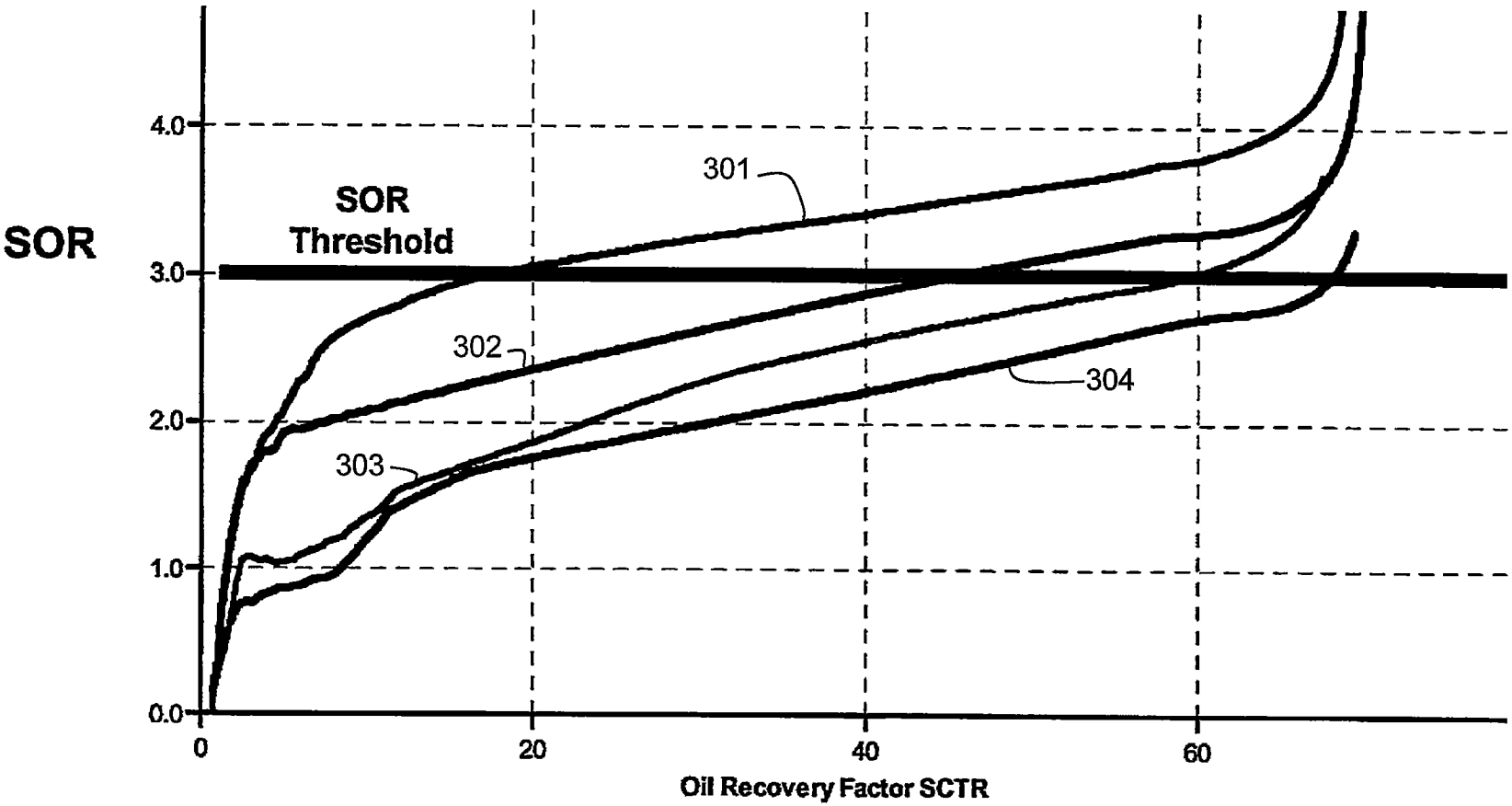
FIG. 3 is a graph showing influences of a heat thief zone on production when injecting steam without and with carbon dioxide, according to embodiments of the invention.

FIG. 3 shows a graph illustrating such influences of a heat thief zone on production when injecting steam without and with carbon dioxide. A first curve 301 and a second curve 302 correspond to injection of steam without carbon dioxide and respectively with and without water above a hydrocarbon reservoir being produced. A third curve 303 and a fourth curve 304 represent injection of steam along with 10 weight percent carbon dioxide and respectively with and without water above a hydrocarbon reservoir being produced.

For an exemplary steam-to-oil ratio threshold of 3.0, injecting the steam alone only enabled about a 20% recovery with top water, which is over a 50% reduction from the recovery achieved with the injection of steam alone when there is no top water. However, presence of the top water relative to no thief zone resulted in less than a 15% reduction in the oil recovery at the threshold of 3.0 for the steam-to-oil ratio when the carbon dioxide was injected with the steam. Regardless of top water presence, the carbon dioxide injection with the injection of the steam provided at least 60% recovery of the products from the reservoir.

The preferred embodiment of the present invention has been disclosed and illustrated. However, the invention is intended to be as broad as defined in the claims below. Those skilled in the art may be able to study the preferred embodiments and identify other ways to practice the invention that are not exactly as described herein. It is the intent of the inventors that variations and equivalents of the invention are within the scope of the claims below and the description, abstract and drawings are not to be used to limit the scope of the invention.

The invention claimed is:

1. A method, comprising:

injecting a fluid introduced into a subterranean formation at a pressure of at least 3000 kilopascals and up to a fracture pressure of the formation, wherein the pressure is selected to provide at least 2 mass percent carbon dioxide solubility in hydrocarbons at an interface where steam condenses and heats the hydrocarbons and the fluid includes the steam with between 5 and 15 weight percent carbon dioxide; and producing hydrocarbons from the formation that are mobilized by the fluid injected.

2. The method according to claim 1, further comprising generating the fluid by oxy combustion in presence of water.

3. The method according to claim 1, wherein the injecting is through a first wellbore spaced from a second wellbore located deeper in the formation than the first wellbore and through which the producing occurs.

4. The method according to claim 1, wherein the fluid contains at least 9 weight percent carbon dioxide and less than 12 weight percent carbon dioxide.

5. The method according to claim 1, wherein the fluid is injected at 4000 kilopascals over a period of at least 5 years.

6. The method according to claim 1, wherein the fluid contains less than 1 weight percent of constituents other than the steam and carbon dioxide.

7. The method according to claim 1, wherein the fluid includes hydrocarbon-containing solvent for the hydrocarbons being produced and having a lower viscosity than the hydrocarbons being produced.

8. The method according to claim 1, wherein the pressure is selected to provide at least 5 mass percent carbon dioxide solubility in the hydrocarbons at an interface where the steam condenses and heats the hydrocarbons.

9. The method according to claim 1, wherein the pressure is selected to provide at least 40 percent oil recovery from the formation over 10 years.

10. A method, comprising:

selecting injection pressure up to a fracture pressure of a subterranean formation and at least 3000 kilopascals, wherein the injection pressure is further selected to provide at least 2 mass percent carbon dioxide solubility in the hydrocarbons at an interface where steam condenses and heats the hydrocarbons; injecting the fluid at the injection pressure into the formation, wherein the fluid includes the steam with at least 5 weight percent carbon dioxide; and producing the hydrocarbons from the formation that are mobilized by the fluid injected.

11. The method according to claim 10, further comprising generating the fluid by oxy combustion in presence of water.

12. A method, comprising:

generating a fluid by oxy combustion in presence of water, wherein the fluid includes steam with between 5 and 15 weight percent carbon dioxide and less than 1 weight percent of other constituents; selecting injection pressure at 4000 kilopascals to provide at least 2 mass percent carbon dioxide solubility in hydrocarbons at an interface where steam condenses and heats the hydrocarbons;

injecting the fluid at the injection pressure into a formation; and producing the hydrocarbons from the formation that are mobilized by the fluid injected, wherein the injecting is through a first wellbore spaced from a second wellbore located deeper in the formation than the first wellbore and through which the producing occurs.

* * * * *